United States Patent [19]

Takeda et al.

[11] 4,137,713

[45] Feb. 6, 1979

[54] INTERNAL COMBUSTION ENGINE SECONDARY AIR INJECTION COMPENSATING SYSTEM

[75] Inventors: Keiso Takeda, Susono; Hideo Miyagi, Toyota, both of Japan

[73] Assignee: Toyota Jidosha Kogyo Kabushiki Kaisha, Toyota, Japan

[21] Appl. No.: 801,760

[22] Filed: May 31, 1977

[30] Foreign Application Priority Data

Mar. 11, 1977 [JP] Japan ..... 52-26090

[51] Int. Cl.[2] ..... F02B 75/10; F01N 3/10

[52] U.S. Cl. ..... 60/276; 60/289

[58] Field of Search ..... 60/276, 289, 290

[56] References Cited

U.S. PATENT DOCUMENTS

| | | | |
|---|---|---|---|
| 3,911,674 | 10/1975 | Goto | 60/290 |
| 3,931,710 | 1/1976 | Hartel | 60/290 |
| 3,962,867 | 6/1976 | Ikeura | 60/290 |
| 4,068,472 | 1/1978 | Takata | 60/290 |

*Primary Examiner*—Douglas Hart

[57] ABSTRACT

An internal combustion engine having an exhaust system provided with exhaust gas purifying means and secondary air supplying means disposed upstream thereof includes a secondary air injection compensating system comprising vacuum introducing means adapted to introduce and reserve the vacuum from an intake manifold vacuum port; secondary air switching means including two diaphragm means and a valve mechanism linked therewith; information processing means adapted to process the information from and $O_2$ sensor and an acceleration detector to make a selection therefrom and issue a command; and vacuum switching means including two vacuum switching valves for selective conduction of said vacuum to said secondary air switching means by said command, and a compensating switching valve. The information processing means operate to communicate either of said two vacuum switching valves with the vacuum and the other with the atmosphere simultaneously and, under the secondary air injecting condition, cause said compensating switching valve to induce atmospheric air into the atmosphere communication system.

2 Claims, 4 Drawing Figures

INTERNAL COMBUSTION ENGINE SECONDARY AIR INJECTION COMPENSATING SYSTEM

BACKGROUND OF THE INVENTION

1. Field of the Invention

This invention relates in general to an exhaust gas purifying system for an internal combustion engine, and more particularly to a secondary air injection compensating-system adapted to prevent uneven secondary air supply due to a large variation in air fuel ratio which occurs during acceleration, thereby effecting secondary air compensation with high accuracy.

2. Description of the Prior Art

In an internal combustion engine having an exhaust system provided with a catalytic device and a secondary air supply system positioned upstream thereof, it is desirable to control the secondary air fuel ratio to the theoretical raio (excess air ratio $\lambda = 1$) in conformity with the operating condition. However, in the prior art system wherein secondary air supplied from its source is delivered, through the operation of an air by-pass valve responsive to the vacuum in the intake manifold, to a secondary air switching valve which is actuated by the manifold vacuum through a vacuum transmitting valve, there occur fluctuations in the amount of injected secondary air according to the position of the air switching valve so that difficulties have been encountered in accomplishing optimal secondary air compensation. Means have therefore been wanted to ensure sufficiently accurate secondary air supply to achieve the desired effect.

Particularly, at the time of engine acceleration, stepping on the accelerator pedal tends to cause a decrease in air fuel ratio which is attributable to the characteristics of the carburetor, and also tends to cause insufficient secondary air supply so that there may arise a phenomenon undesirable from the viewpoint of air pollution by exhaust gas. In order to normalize the air fuel ratio during acceleration, it is desirable to make an adequate increase in fuel flow in accordance with the acceleration as well as fuel supply from the accelerating system of the carburetor. This, however, has no relation with countermeasures concerning the secondary air system and is very difficult to practice in a suitable manner in view of the operating characteristics of the engine.

SUMMARY OF THE INVENTION

In order to solve the above described problem, the present invention aims to provide a system for precise secondary air supply compensation which receives an oxygen concentration signal from an $O_2$ sensor disposed upstream of an exhaust gas purifying device and an acceleration signal from an acceleration detector linked with the accelerator pedal, and processes the signal to make a selection therefrom and deliver an adequate signal to vacuum switching means, which perform a switching function for selective conduction of the manifold vacuum to secondary air switching means, thereby effecting adequate secondary air supply and interruption thereof.

According to such arrangement of the present invention, when the accelerator pedal is depressed for acceleration, the possibility of occurrence of insufficient secondary air supply in the exhaust sytem is previously detected to effect selective operation of vacuum switching valves through information processing means, and consequently a secondary air switching valve operatively connected to the vacuum switching valves operates to supply secondary air in desired increased amount. It is thus possible to prevent the deteriorated mixture control capability and CO spike generation due to a large variation in air fuel ratio which occurs during acceleration as a phenomenon characteristic of the carburetor, and to eliminate uneven secondary air supply, so that the desired accurate compensation is attainable.

DESCRIPTION OF THE PREFERRED EMBODIMENT

Figure 1:
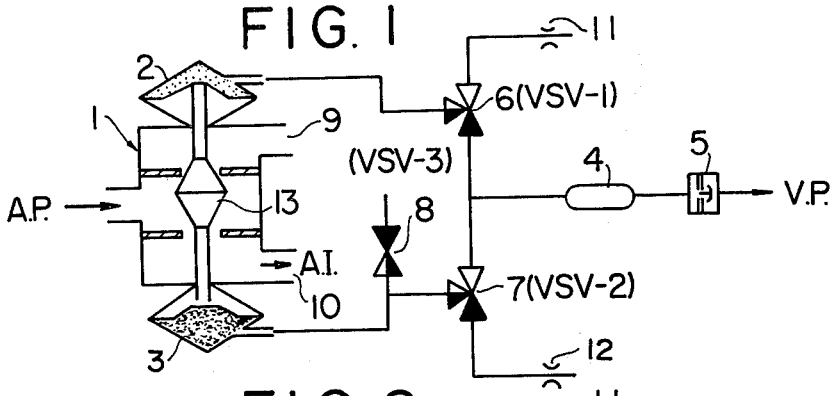
FIGS. 1 and 2 schematically illustrate the composition and function of a secondary air injection compensating system embodying the present invention, showing the system as functioning when the mixture in the exhaust system is rich and lean, respectively.
Figure 2:
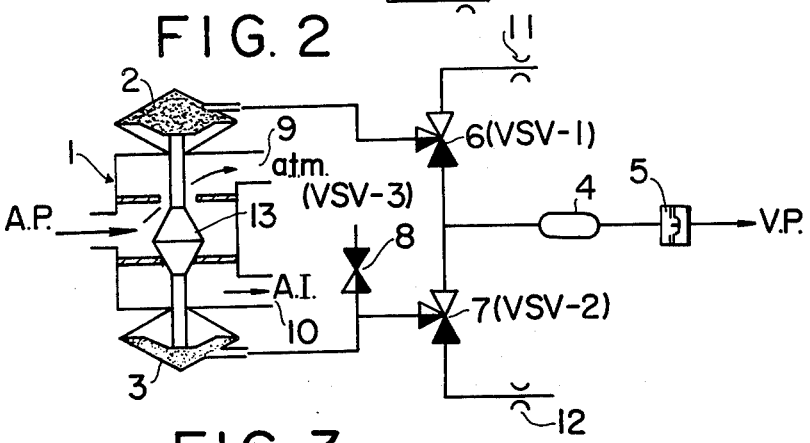
Figure 3:
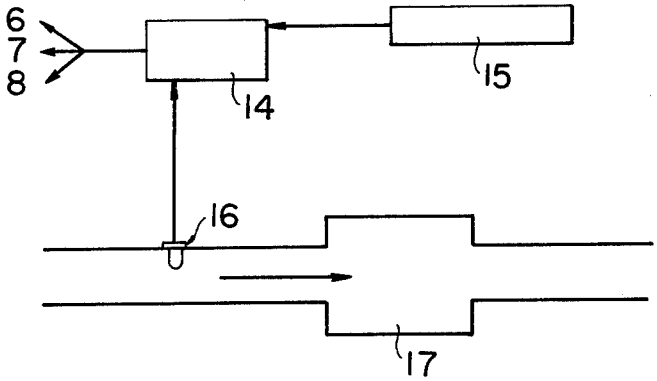
FIG. 3 is a diagrammatic illustration of an information processing system which constitutes a part of the present invention.

Referring now to the accompanying drawings, and particularly to FIGS. 1 and 2, which show a secondary air injection compensating system embodying the present invention in the condition of supplying an increased amount of secondary air and in the condition of interrupting such supply, respectively; the system of the invention includes vacuum introducing means, vacuum switching means, and secondary air means. The vacuum introducing means comprise a vacuum transmitting valve 5 in fluid communication with an intake manifold vacuum port V.P., and a vacuum reservoir 4 connected in series flow relationship with the vacuum transmitting valve 5. The vacuum switching means include a first vacuum switching valve 6(VSV-1), a second vacuum switching valve 7(VSV-2) and a third vacuum switching valve 8(VSV-3). The secondary air switching means include a secondary air switching valve generally represented by 1, which has diaphragm means including a first diaphragm chamber 2, a second diaphragm chamber 3, and two diaphragms operatively connected respectively to opposed ends of two valve stems oppositely extending from a valve head 13 adapted to perform such a switching function as to communicate secondary air with either an atmosphere port 9 or a secondary air delivery port 10 by the cooperation of both diaphragm chambers. Futhermore, as seen in FIG. 3, which shows an information processing system, the exhaust system is provided with a catalytic converter 7 and information processing means which include a computer 14 for processing the information from an $O_2$ sensor 16 located upstream of the catalytic converter 17 and the information from an acceleration detector 15 and together with the above-mentioned other means, compose the system of the present invention.

VSV-1 and VSV-2, used in the rich mode and the lean mode, respectively, are normally controlled by the signal from the $O_2$ sensor 16 through the operation of the computer 14 in such a manner as to be set, when the exhaust mixture is rich in fuel, in the ON position (for the first fluid communication system) to deliver secondary air into the exhaust system, and when the mixture is lean, in the OFF positions (for the second fluid communication system) to shut off the delivery of secondary air. VSV-3 serves to cause instantaneous and precise supply of secondary air in increased amount by the acceleration signal from the acceleration detector 15 and is controlled together with the other vacuum switching valves (VSV-1 and VSV-2) by the computer 14.

Reference is now made again to FIG. 1, which illustrates the function of the present compensating system when the gas mixture in the exhaust system is rich. The manifold vacuum led through the vacuum transmitting valve 5 into the vacuum reservoir 4 and kept therein is conducted through VSV-1 into the first diaphragm chamber 2, pursuing the shown first fluid communication line, and tends to move the diaphragm upward as viewed in the figure. Meanwhile, VSV-2 allows the ambient air admitted through its specific orifice 12 provided in an atmosphere opening to pass into the second diaphragm chamber 3. This atmosphere introduction is effective to determine the operating speed of the valve head 13.

VSV-3, used in the acceleration mode, is to be actuated by the signal from the acceleration detector and therefore normally remains in the OFF position (for the second fluid communication system).

At the time of acceleration, the acceleration detector operates to set VSV-1 VSV-2 and VSV-3 to the ON position (for the first fluid communication system) regardless of the signal from the $O_2$ sensor. (At the beginning of acceleration, influenced by the operation of the accelerator pump, the mixture becomes rich, thus causing CO spike generation). In addition to the operation of VSV-1 and VSV-2, VSV-3 operates to introduce additional air, through the first fluid communication course shown, into the aforementioned atmosphere introduction system at an intermediate point thereof, so that the diaphragm of the second diaphragm chamber 3 tends to move upward positively and instantaneously. This moving tendency of the diaphragm cooperates with that of the diaphragm of the first diaphragm chamber 2 to raise the valve head 13 positively and instantaneously, with the result that the passage leading to the secondary air delivery port 10 is opened to delivery secondary air to the exhaust system of the engine. The time during which the vacuum switching valves VSV-1, VSV-2 and VSV-3 are set in the ON positions (for the first fluid communication system) by the operation of the acceleration detector, that is, the operation time for supply of an increased volume of secondary air can be optionally determined by a timer provided in the computer 14.

Referring to FIG. 2, which is a functional illustration associated with the condition wherein the exhaust mixture is lean, the vacuum switching valves are actuated by the computer 14 so as to establish the second fluid communication system. Thus, the intake manifold vacuum is introduced into the second diaphragm chamber 3 through VSV-2, while the VSV-1 is set to allow atmospheric air to pass through its specific orifice 11 into the first diaphragm chamber 2. As a result, both diaphragms cooperate to move the valve head 13 downward as viewed in the figure, thereby opening the atmosphere port 9 of the secondary air switching valve 1, so that the secondary air delivered from the air pump is discharged into the atmosphere or returned to the air cleaner of the engine. Just as in the case where the exhaust mixture is rich, the throttling capability of the orifice 11 placed in conjunction with VSV-1 can be optionally determined, and hence the time of moving the valve head 13 to either side can be determined as desired.

Figure 4:
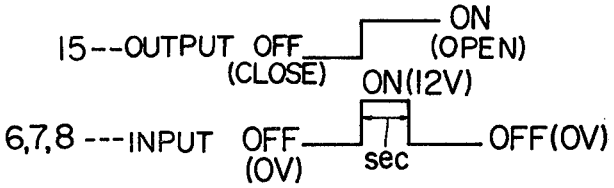
FIG. 4 shows the operational relation between an acceleration detector and vacuum switching valves.

FIG. 4 shown the relation between the output from the acceleration detector and the input to each vacuum switching valve which operates in response to the detector output.

What is claimed is:

1. In an internal combustion engine having an exhaust system provided with exhaust gas purifying means and secondary air supply means disposed upstream thereof; a secondary air injection compensating system comprising vacuum introducing means adapted to introduce intake manifold vacuum from an intake manifold vacuum port through a vacuum transmitting valve into a vacuum reservoir and reserve the manifold vacuum in said reservoir; secondary air switching means including two diaphragm means and a valve mechanism linked therewith; information processing means adapted to process the information from an $O_2$ sensor and an acceleration detector to make a selection therefrom and issue a command; vacuum switching means including two vacuum switching valves for selective conduction of said vacuum to said secondary air switching means by said command and a compensating switching valve; and means responsive to detection of acceleration to cause said compensating switching valve to communicate atmospheric air to a diaphragm for more rapid initiation of secondary air injection, said information processing means being adapted to simultaneously communicate one of said two vacuum switching valves with the vacuum and the other with the atmosphere and, under the secondary air injecting condition, cause said compensating switching valve to induce atmospheric air into the atmosphere communication system, thereby precisely operating said valve mechanism.

2. An internal combustion engine secondary air injection control system as set forth in claim 1, wherein said two vacuum switching valves have respective atmosphere inducing means each provided with an orifice of predetermined throttling capability.

* * * * *